United States Patent [19]

Raz

[11] 4,305,163

[45] Dec. 15, 1981

[54] TOILET BOWL FLUSH SYSTEM

[75] Inventor: Zeev Raz, Beer Sheva, Israel

[73] Assignee: Ben-Gurion University of the Negev Research and Development Authority, Beer Sheva, Israel; a part interest

[21] Appl. No.: 85,961

[22] Filed: Oct. 18, 1979

[30] Foreign Application Priority Data

Nov. 5, 1978 [IL] Israel ..... 55874

[51] Int. Cl.[3] ..... E03D 1/00; E03D 1/14; E03D 1/34

[52] U.S. Cl. ..... 4/325; 4/379; 4/383; 4/394; 4/405

[58] Field of Search ..... 4/324–327, 4/378, 379, 381, 382–385, 390, 391, 394–396, 405, 413, 414, DIG. 1, 393, 415

[56] References Cited

U.S. PATENT DOCUMENTS

| | | | |
|---|---|---|---|
| 2,101,991 | 12/1937 | Finley et al. | 4/381 X |
| 2,270,989 | 1/1942 | Asselin | 4/382 |
| 2,690,567 | 10/1954 | Quebbeman | 4/381 |
| 2,819,471 | 1/1958 | Ezzell | 4/382 |
| 3,141,177 | 7/1964 | Kertell | 4/325 |
| 3,156,930 | 11/1964 | Moulton et al. | 4/325 |
| 3,421,161 | 1/1969 | Stafford et al. | 4/325 |
| 3,766,571 | 10/1973 | Elder et al. | 4/326 |
| 3,945,056 | 3/1976 | Kowalski | 4/325 |
| 4,025,968 | 5/1977 | Davis | 4/325 |
| 4,086,667 | 5/1978 | Miklos | 4/325 |
| 4,117,556 | 10/1978 | Semler | 4/381 X |
| 4,128,906 | 12/1978 | Raz | 4/325 |

FOREIGN PATENT DOCUMENTS 764749 8/1977 South Africa .

*Primary Examiner*—Stuart S. Levy
*Attorney, Agent, or Firm*—Holman & Stern

[57] ABSTRACT

A flush valve mechanism for controlling the flushing action of water through the water outlet of a flush cistern is provided. The mechanism comprises a water outlet valve liftable off the water outlet to effect the flushing action and a buoyant, valve-engaging assembly adapted to move independently of the water outlet valve by virtue of its buoyancy. The water outlet valve having an effectively negative overall buoyancy when the cistern is at least partially full. The valve-engaging assembly comprises a pivotably mounted buoyant lever having at least one arm with a buoyant means attached at one end thereof adjacent the bottom of the cistern and is provided with means at its other end for selectively engaging the valve. The assembly further comprises restraining means having a first position normally engaging and restraining the buoyant lever with the buoyant means in close proximity to the cistern bottom and the engaging means in disengaged relationship to the valve. The restraining means are displaceable to assume a second position freeing the buoyant lever and allowing the same to engage and to exert a maintaining force on the water outlet valve at the completion of the lifting thereof to overcome its negative buoyancy and to hold it open until the completion of the flushing action.

12 Claims, 8 Drawing Figures

TOILET BOWL FLUSH SYSTEM

The present invention relates to a flush valve mechanism for the water outlet of a flush cistern. More particularly, the present invention relates to a novel and improved flush valve mechanism effective for single volume flushing cisterns and readily and simply adaptable to function as a selective volume flush valve mechanism for selectively allowing both partial and complete flushes as well.

Dual or selective flushing cisterns have been described in the prior art, e.g., in U.S. Pat. Nos. 2,351,672; 2,731,647; 2,864,095; 3,026,536; 3,156,930; 3,758,893 and 3,766,571; 3,823,425; 3,908,203; 3,964,109 and 4,038,708 which patents involve replacing or substantially modifying the existing valve mechanism with a new and usually complicated and expensive two-level selective volume valve assemblies for providing optional partial and complete flushes. However, to date, there has yet to be introduced on the market a simple, reliable and inexpensive flush valve mechanism suitable to replace the air-bell, suction cup or siphon-type flush valve mechanisms in countries where dual flush sytems are not yet allowed and readily adaptable to function as a dual or selective flush valve mechanism in countries where such systems are allowed.

Thus, according to the present invention, there is now provided a flush valve mechanism for controlling the flushing action of water through the water outlet of a flush cistern comprising a water outlet valve liftable off said water outlet to effect said flushing action and a buoyant, valve-engaging assembly adapted to move independently of said water outlet valve by virtue of its buoyancy, said water outlet valve having an effectively negative overall buoyancy when the cistern is at least partially full, and said assembly comprising a pivotably mounted buoyant lever having at least one arm with a buoyant means attached at one end thereof adjacent the bottom of said cistern and provided with means at its other end for selectively engaging said valve, said assembly further comprising restraining means having a first position normally engaging and restraining said buoyant lever with said buoyant means in close proximity to said cistern bottom and said engaging means in disengaged relationship to said valve and said restraining means being displaceable to assume a second position freeing said buoyant lever and allowing the same to engage and to exert a maintaining force on said water outlet valve at the completion of the lifting thereof to overcome its negative buoyancy and to hold it open until the completion of the flushing action.

In several of the preferred embodiments of the present invention said buoyant lever is adapted upon displacement of said restraining means to exert a frictional maintaining pressure against a section, preferably an upright wall section, of the water outlet valve to overcome the effectively negative overall buoyancy of said water outlet valve while the cistern is emptying until the completion of the flushing action, while in other, especially preferred embodiments, said buoyant lever is adapted, upon displacement, to exert a pressure against an upright wall section of a channeled guide and mounting unit, in the channels of which a depending vertical arm of the water outlet vale is adapted to vertically move, wherein said buoyant lever thereby blocks the downward path of said depending arm and effectively prevents the descent of the valve stem until the completion of the flushing action.

In another aspect of the present invention, as defined, there is provided a selective volume flush valve mechanism, adapted to selectively allow both partial and complete flushes, comprising a water outlet valve having an effectively positive overall buoyancy when the water in the cistern is at a predetermined full level and an effectively negative overall buoyancy when the water in the cistern is emptied to a second lower partially full level and further comprising dual actuating means for said flush valve mechanism, the first of said means comprising a mechanism for effecting the disengagement of said valve from said water outlet to effect partial flushes and the second of said actuating means comprising a mechanism for effecting the disengagement of said valve from said water outlet and for displacing said restraining means from its first position to said second position to enable said buoyant lever to exert a maintaining force on said disengaged water outlet valve to overcome its negative buoyancy while the cistern is emptying, until the completion of a complete flush.

Also provided is a single volume flush valve mechanism of the type defined comprising means for displacing said restraining means from its first position to said second position, upon the disengagement of said valve from said water outlet, to enable said buoyant lever to engage said disengaged water outlet and to exert a maintaining force thereon to overcome its negative buoyancy while the cistern is emptying, until after the completion of the flushing action.

In South African Pat. No. 76/4749 there is described a cistern outlet valve assembly including a pivotably mounted buoyant valve engaging arm adapted to move independently of said water outlet valve by virtue of its buoyancy and designed to cooperate with the valve stem to hold the valve open until the float of said valve engaging arm drops downwardly.

In contradistinction to the mechanism of the present invention said valve engaging arm is provided with a formation which frictionally engages the valve stem throughout the period when the float of said arm is immersed in water and is not provided with displaceable restraining means which assures interaction of the buoyant lever arm with the valve stem only after said stem has been lifted and until the completion of the flushing action. As will be realized, the displaceable restraining means of the present invention prevent constant engagement and friction between the engaging arm and the valve stem, which tends to result in the rapid wearing out of parts, and also prevent the constant engagement between the engaging arm and the valve stem during lifting of the valve stem which, in said South African Patent assembly, results in the valve stem being held open at different heights each time and the consequent creation of different flow velocities with each flush.

Preferably said restraining means comprise a rod disposed in a channel for guided vertical displacement, said rod having a face surface which in said first position abuts a surface of said buoyant lever and prevents the movement thereof towards said valve. Furthermore, said rod is preferably provided with engagement means rendering the same liftable simultaneously with the water outlet valve whereby upon the lifting of said water outlet valve and said restraining means said buoyant lever is freed to engage and exert a maintaining force on said lifted water outlet valve as will be described more fully hereinafter.

In especially preferred embodiments of the present invention said restraining means comprise a rod having a forked bottom section the web of which fork acts as the abutment face of said restraining means and said engaging means of said buoyant lever extends between the legs of said forked rod upon displacement thereof to engage said water outlet valve.

While the invention will now be described in connection with certain preferred embodiments with reference to the following illustrative figures so that it may be more fully understood, it is stressed that the particulars shown and described are by way of example, and for purposes of illustrative discussion only, and are presented in the cause of providing what is believed to be the most useful and readily understood description of the principles and conceptual aspects of the invention. In this regard no attempt is made to show structural details of the water cistern and its components in more detail than is necessary for a fundamental understanding of the invention, the description taken with the drawings making apparent to those skilled in the art how the several forms of the invention may be embodied in practice.

Figure 1:
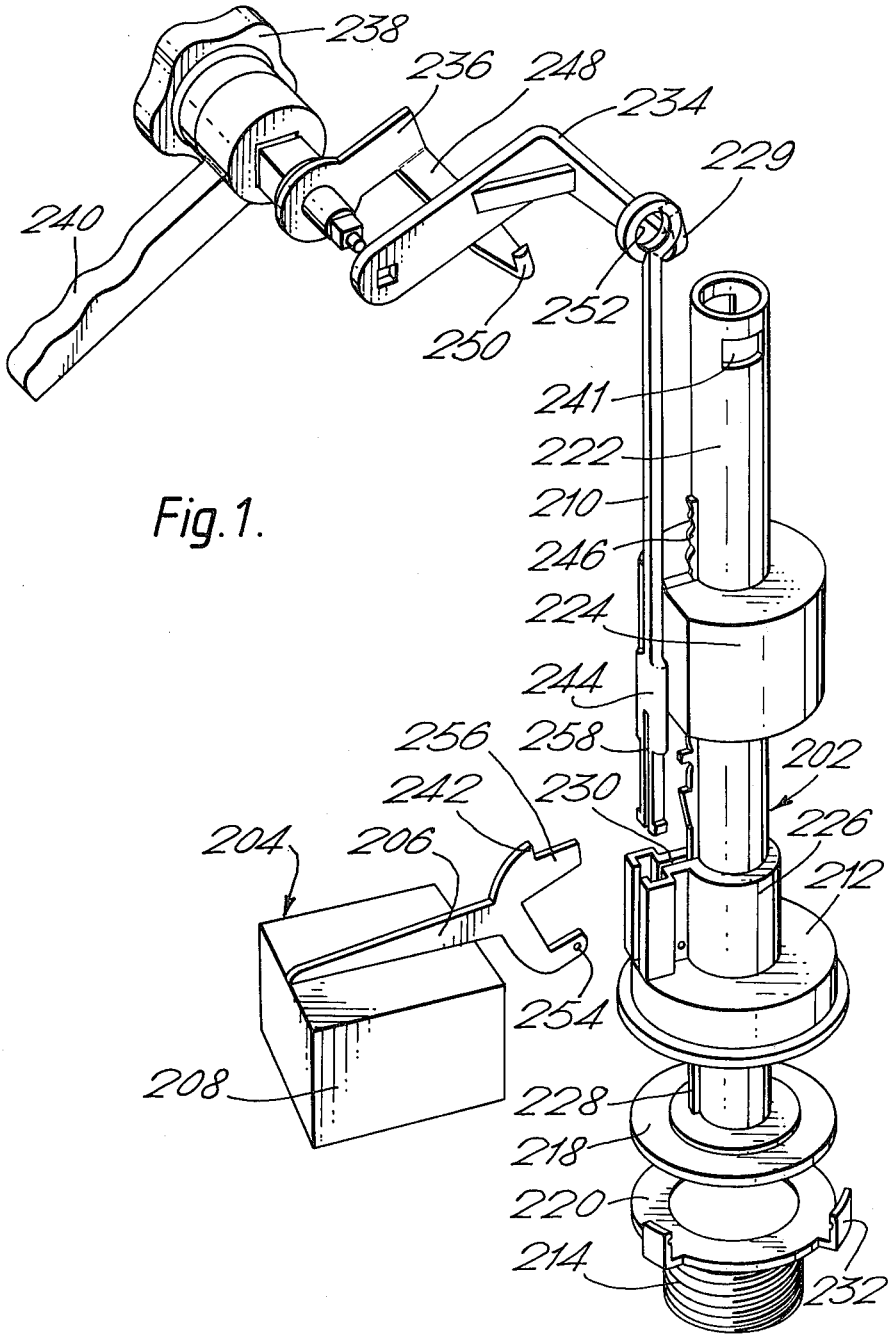
FIG. 1 is an exploded isometric view of one embodiment of a flush valve mechanism according to the invention.

Referring first to FIG. 1 there is shown in exploded view a preferred embodiment of a flush valve mechanism according to the present invention. As seen, said flush valve mechanism comprises a water outlet valve 202 and a buoyant valve engaging assembly which assembly comprises a pivotably mountable buoyant lever 204 having at least one arm 206 with a buoyant means 208 attached thereto and further comprising restraining means 210 whose function will be better described with reference to FIGS. 2 and 3.

Also shown is an integral mounting plate 212 and water outlet 214 which is adapted to be attached to the bottom 216 (see FIGS. 2 and 3) of the flush cistern and to form the water outlet therefor. It should be noted, however, that said mounting plate and/or its component parts could be manufactured as an integral part of the bottom of a water cistern if desired by manufacturers thereof. The water outlet valve 202 has a valve disc 218 adapted to seal valve seat 220 of water outlet 214 and an upwardly extending valve stem 222. Said valve stem can be advantageously hollowed as shown to constitute the overflow pipe of the cistern thereby eliminating the need for the separate provisions thereof. Said stem is provided in the embodiments of FIGS. 1–3 with buoyant means 224 preferably made of foamed polystyrene, or a hollow sealed plastic body or the like.

The valve mechanism of the present embodiment is preferably a lift valve as shown designed for vertical displacement only, by providing mounting plate 212 with an upwardly extending tubular housing 226 adapted to receive the disc 218 and the lower portion of stem 222 of the valve 202 for vertical displacement. As will be noted, stem 222 is provided with a vertical rib 228 extending therefrom and housing 226 is provided with a corresponding channel 230 to receive and guide said rib.

The mounting plate 212 is itself mounted by means of coupling legs 232 in vertical spaced apart relationship from valve seat 220 of water outlet 214 so as to form, upon displacement of disc 218 from valve seat 220, a multidirectional water outflow passage between seat 220 and plate 212 and between said legs 232.

Figure 2:
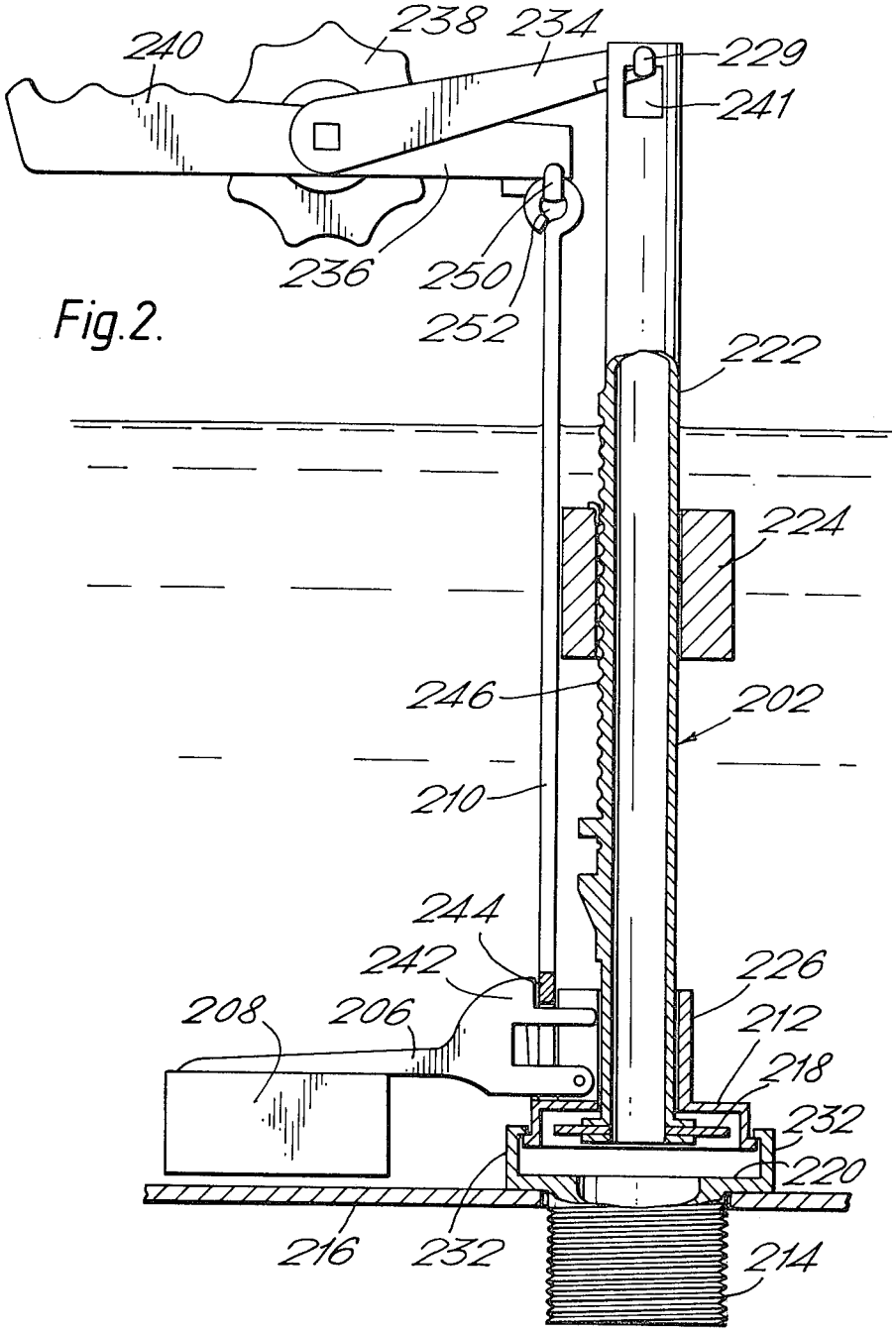
FIGS. 2 and 3 are back views partly in section of the flush valve mechanism of FIG. 1 in different operating positions inside a water flush cistern, only a bottom section of which is shown for clarity.
Figure 3:
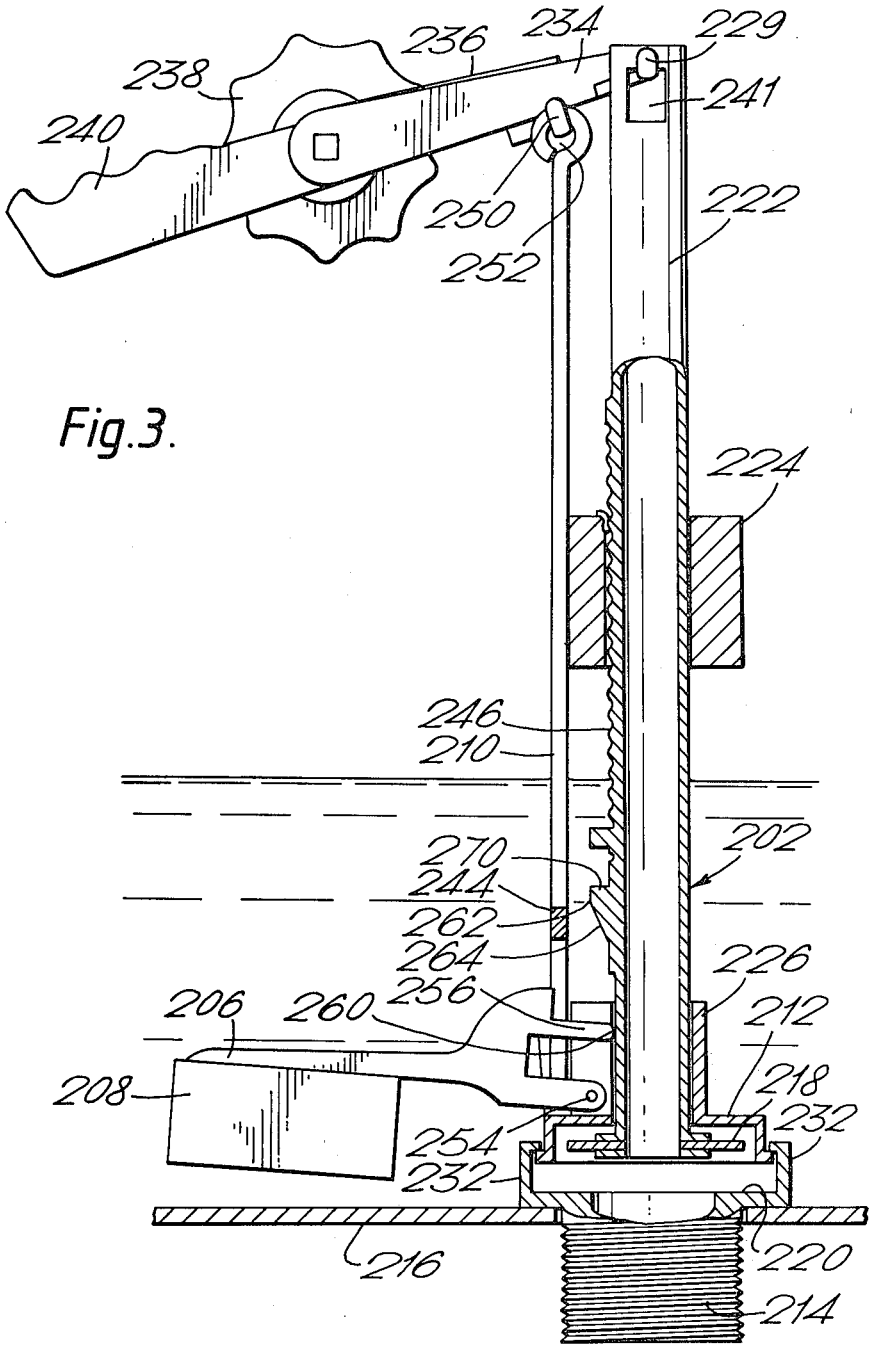

Referring now also to FIGS. 2 and 3 which are intended to respectively illustrate the operation of said flush valve mechanism as a selective volume mechanism adapted to selectively allow both partial and complete flushes, said mechanism is provided with dual actuating levers 234 and 236 each respectively coupled to a separate operating handle 238 and 240.

When a partial flush capability is desired water outlet valve 202 is provided with buoyant means 224 for controlling the effective overall buoyancy thereof so that said lift-valve will have an effectively positive overall buoyancy when the water in the cistern is at a predetermined full level and an effectively negative overall buoyancy when the water in the cistern is emptied to a second lower partially full level. In operation to effect a partial flush, as shown specifically with reference to FIG. 2, handle 238 is rotated to cause the lifting of actuating lever 234 which is provided at its other end with a hook 229 adapted to be hooked in aperture 241 provided in valve stem 222 and to lift the same to effect the disengagement of the valve 202 from said water outlet as shown.

As a result of the effective buoyancy of valve 202, said valve remains open only until the water in the cistern is emptied to a predetermined partially full level whereafter the effectively negative overall buoyancy of said valve causes the same to return to its normal rest position closing said water outlet and resulting in a partial flushing action of said cistern. As will be realized since handle 240 is not pulled during said desired partial flushing action restraining means 210 is not displaced from its first position as shown and acts to restrain said buoyant lever 204 in its rest position with buoyant means 208 in relatively close adjacency to the bottom 216 of the cistern by virtue of the restraining abutment of face 244 of the forked rod restraining means 210 against projection 242 of lever arm 206.

With regard to the overall buoyancy of said water outlet valve as will be realized for the embodiments shown in FIGS. 1–3, the entire valve body could be made of a combination of materials having a precalculated effective overall buoyancy adapted to achieve the above effect without the need for special buoyant means 224 to be attached thereto.

On the other hand, the provision of attachable buoyant means 224 which could also be adjustably positionable along the stem 222 by the provision of a toothed projecting rib 246 as shown will facilitate the factory adjustment of the effective buoyancy and the amount of water dispensed in a partial flush according to local standards and conditions in countries where partial flushing mechanisms are permitted and will also enable the eleminating of said buoyant means 224 and said attachable toothed projecting rib 246 and the creation of a water outlet valve having an effectively negative overall buoyancy even when the cistern is completely full, thus limiting the use of the mechanism to single full volume flushes in countries not allowing dual flush mechanisms. In such countries, of course, handle 238 and actuating lever 236 can also be eliminated, as will be described hereinafter with reference to FIG. 4.

Referring specifically to FIG. 3, in operation, when a full flush is desired, operating handle 240 linked to actuating lever 236 is pulled downwards whereupon face 248 of actuating lever 236 exerts a lifting effect on lever 234 which in turn lifts and disengages water outlet valve 202 from said water outlet 214 as already described, while hook 250 which is adapted to be hooked in eye 252 of the forked rod restraining means 210 lifts and displaces the same. When said restraining means 210 are displaced to assume the position shown in FIG. 3, face 244 of said forked rod restraining means is lifted away from its abutting relationship with projection 242 of lever arm 206 and due to the buoyancy of buoyant lever 204 said lever arrangement pivots around its pivot connection 254 and nose 256 of lever arm 206, which extends through slot 258 of the forked rod restraining means 210, engages a section 260 of the displaced water valve 202 and exerts a frictional maintaining pressure thereagainst to overcome the effectively negative overall buoyancy of said water outlet valve while the cistern is emptying and in fact until after the completion of the flushing action.

When the water level drops below the buoyant means 208, the buoyant lever 204 will drop, thereby releasing the engagement of nose 256 with said water outlet valve, whereupon said valve, by vurtue of its own weight, will fall back into place with valve disc 218 sealing valve seat 220 of water outlet 214.

Preferably valve stem 222 is also provided with a projection 262 having a slanted surface 264 gradually merging with the lower portion of said stem wherein said slanted surface 264 is adapted in its downward path to further push nose 256 away from said valve stem and thereby assure adequate clearance for the repositioning of face 244 of restraining means 210 in abutting restraining relationship with projection 242 of lever arm 206 as restraining means 210 also returns to its first normal position by virtue of its own weight and/or by the action of lever 236 thereon.

Figure 4:
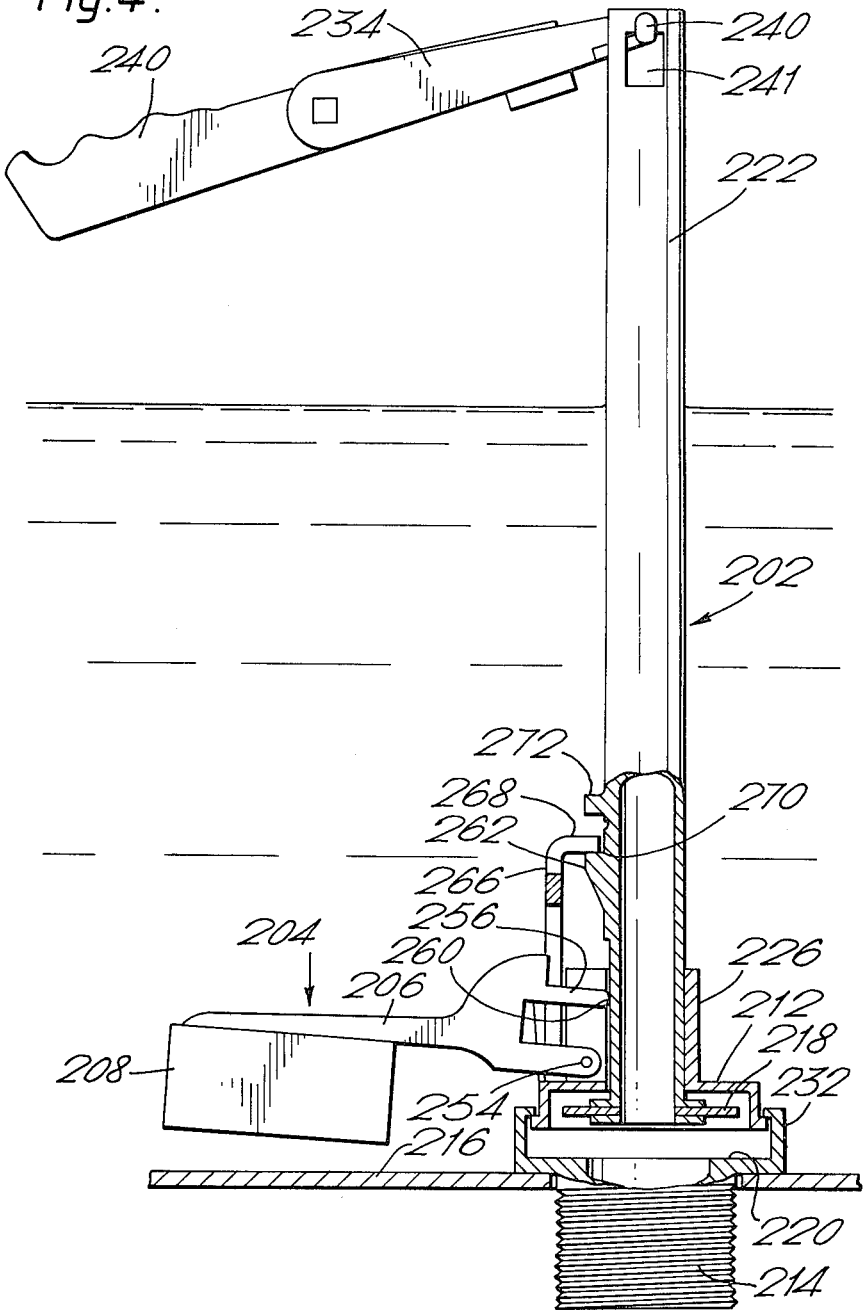
FIG. 4 is a back view partly in section of a modification of the embodiments shown in FIG. 1–3 adapted for single-flush operation only.

Referring now to FIG. 4, there is shown a modification of the embodiments shown in FIG. 1–3 adapted for single flush operation only, wherein buoyant means 224, toothed projecting rib 246, handle 238 and actuating lever 236 have been removed and restraining means 210 has been replaced by restraining means 266 of slightly different configuration the lower section of which corresponds to the lower section of restraining means 210 and which has been modified to include a projecting arm 268, the function of which is described hereinafter, instead of continuing upward and terminating in an eye 252.

Thus, in the embodiment shown, said restraining means 266 is provided with an arm 268 projecting towards said water outlet valve 202 which arm is adapted to be engaged by the top surface 270 of first projection 262 provided on said water outlet valve and lifted thereby upon the disengagement of said valve from said water outlet, and wherein said valve is further provided with a second projection 272 adapted to press against said arm 268 to insure the repositioning of said restraining means in its first position upon the completion of the flushing action and the disengagement of the nose 256 of the buoyant lever 204 from the surface section 260 of said water outlet 202.

The operation of the flushing action of said single volume flush arrangement is in principal the same as that described with reference to FIG. 3 with the exception of the differences already described and the fact that handle 240 acts directly via actuating lever 234 to lift the valve 202 thereby displacing disc 218 from valve seat 220 to initiate the flushing action which then continues until substantially all the water has exited from the cistern to complete the full flushing action due to the action of the restraining means and buoyant lever as described.

Figure 5:
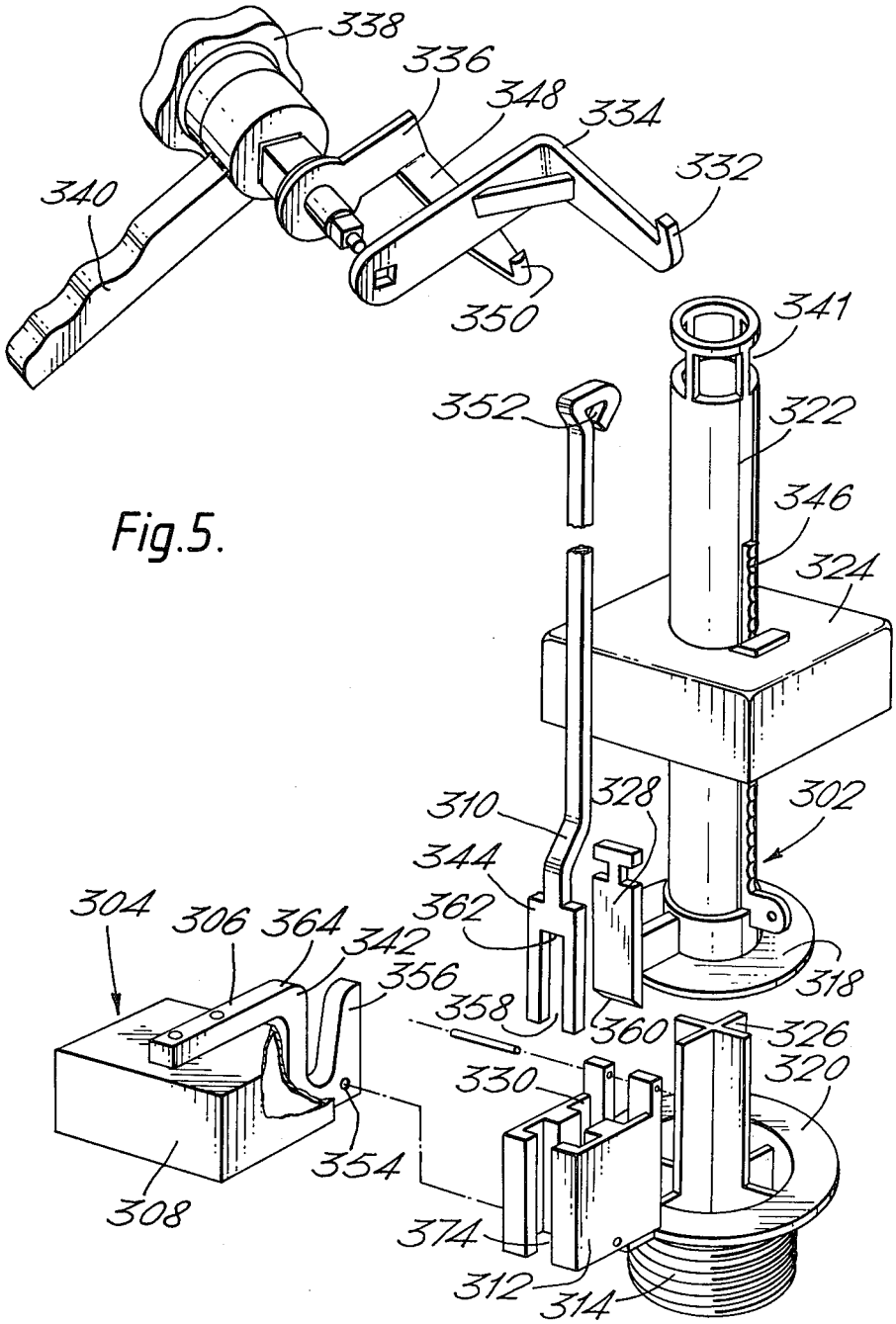
FIG. 5 is an exploded isometric view of one embodiment of a flush valve mechanism according to the invention.

Referring now to FIG. 5 there is shown in exploded view an especially preferred embodiment of a flush valve mechanism according to the present invention. As seen, said flush valve mechanism comprises a water outlet valve 302 and a buoyant valve engaging assembly which assembly comprises a pivotably mountable buoyant lever 304 having at least one arm 306 with a buoyant means 308 attached thereto and further comprising restraining means 310 whose function will be better described with reference to FIGS. 6 and 7.

Also shown is a channeled integral guide and mounting unit 312 and water outlet 314 which is adapted to be attached to the bottom 316 (see FIGS. 6 and 7) of the flush cistern and to form the water outlet therefor. The water outlet valve 302 has a valve disc 318 adapted to seal valve seat 320 of water outlet 314 and an upwardly extending valve stem 322. Said valve stem is also provided in the embodiments of FIG. 5–7 with buoyant means 324, preferably made of foamed polystyrene, or a hollow sealed plastic body or the like.

The valve mechanism of the present embodiment is also preferably a lift valve designed for vertical displacement only, by providing water outlet 314 with an integral upwardly extending guide stem 326 adapted to enter the hollow lower portion of stem 322 of the valve 302 for vertical displacement. As will be noted, stem 322 is provided with a depending vertical arm 328 attached thereto and mounting unit 312 is provided with a corresponding channel 330 to receive and guide said arm 328.

In this manner valve stem 322 is guided in its vertical up and down movement both by guide stem 326 and by guide channel 330.

Figure 6:
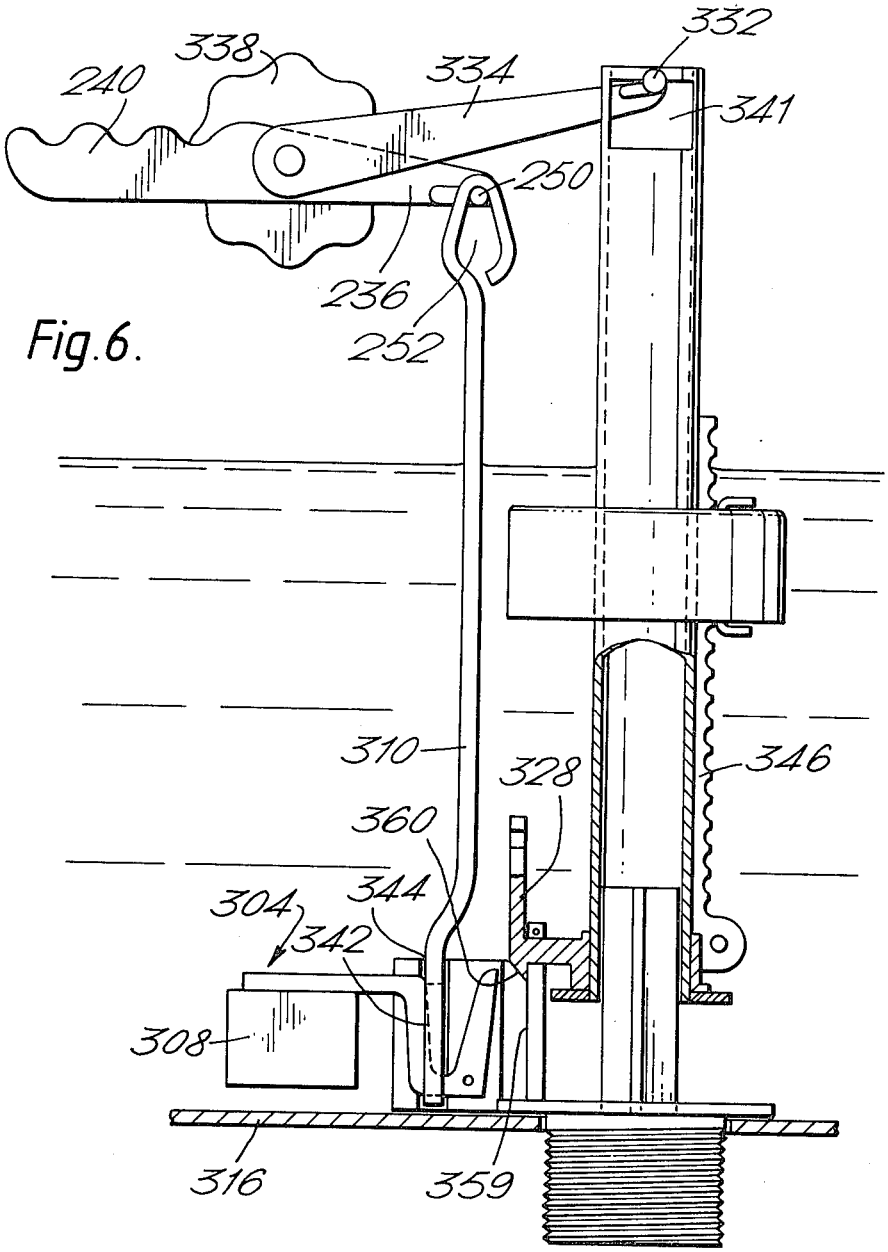
FIGS. 6 and 7 are back views partly in section of the flush valve mechanism of FIG. 5 in different operating positions inside a water flush cistern, only a bottom section of which is shown for clarity.
Figure 7:
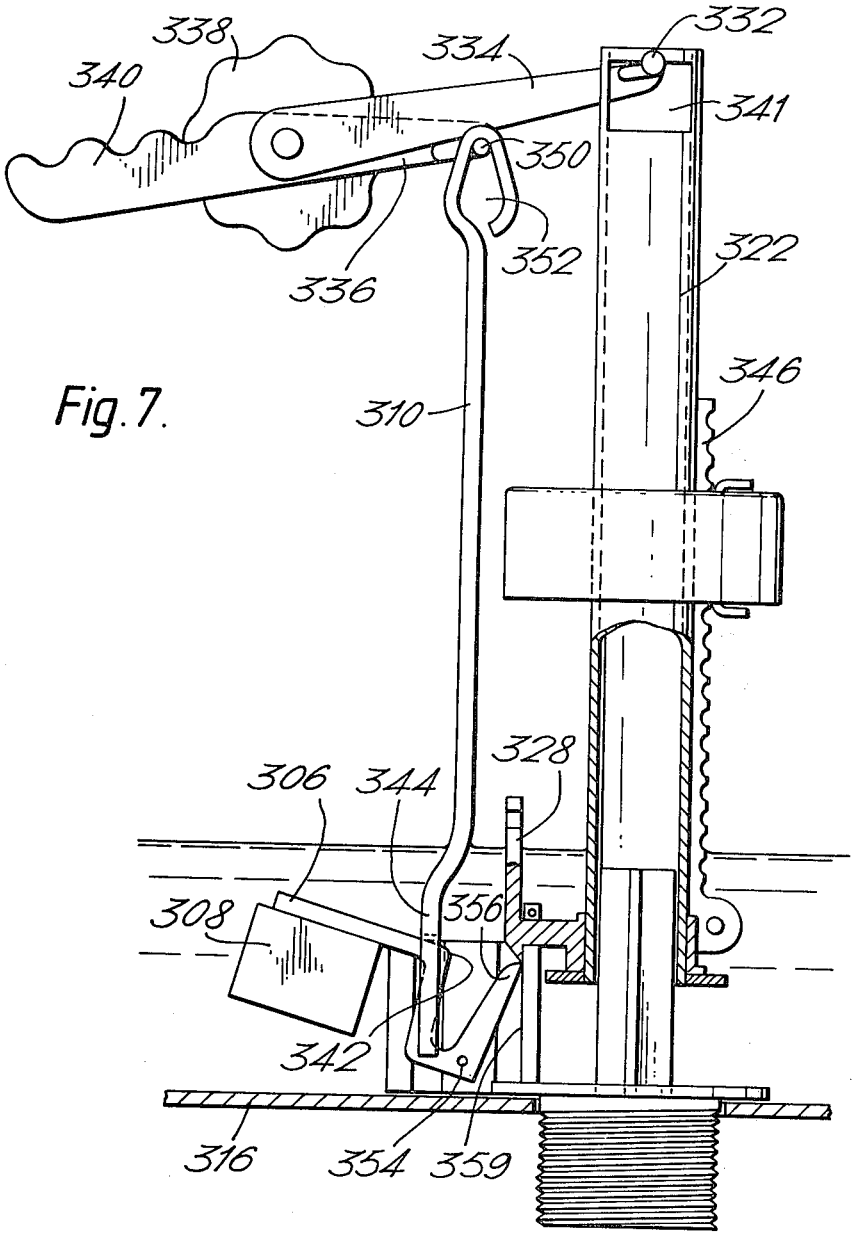

Referring now also to FIGS. 6 and 7 which are intended to respectively illustrate the operation of said flush valve mechanism as a selective volume mechanism adapted to selectively allow both partial and complete flushes, said mechanism is provided with dual actuating levers 334 and 336 each respectively coupled to a separate operating handle 338 and 340 which operates in the same manner as described with reference to levers 234 and 236 and handles 238 and 240 of the embodiments illustrated in FIGS. 1–3.

Thus when a partial flush capability is desired water outlet valve 322 is provided with buoyant means 324 for controlling the effective overall buoyancy thereof so that said lift-valve will have an effectively positive overall buoyancy when the water in the cistern is at a predetermined full lever and an effectively negative overall buoyancy when the water in the cistern is emptied to a second lower partially full lever. In operation to effect a partial flush, as shown specifically with reference to FIG. 5, handle 338 is rotated to cause the lifting of actuating lever 334 which is provided at its other end with a hook 332 adapted to be hooked in aperture 341 provided in valve stem 322 and to lift the same to effect the disengagement of the valve 302 from said water outlet as shown.

As a result of the effective buoyancy of valve 322, said valve remains open only until the water in the cistern is emptied to a predetermined partially full lever whereafter the effectively negative overall buoyancy of said valve causes the same to return to its normal rest position closing said water outlet and resulting in a partial flushing action of said cistern. As will be realized since handle 340 is not pulled during said desired partial flushing action restraining means 310 is not displaced from its first position as shown and acts to restrain said buoyant lever 304 in its rest position with buoyant means 308 in relatively close adjacency to the bottom 316 of the cistern by virtue of the restraining abutment of face 344 of the forked rod restraining means 310 against face 342 of lever arm 306.

Referring specifically to FIG. 7, in operation, when a full flush is desired, operating handle 340 linked to actuating lever 336 is pulled downwards whereupon face 348 (shown in FIG. 5) of actuating lever 336 exerts a lifting effect on lever 334 which in turn lifts and disengages water outlet valve 302 from said water outlet 314 as already described, while hook 350 which is adapted to be hooked in eye 352 of the forked rod restraining means 310 lifts and displaces the same. When said restraining means 310 are displaced to assume the position shown in FIG. 7, face 344 of said forked rod restraining means is lifted away from its abutting relationship with face 342 of lever arm 306 and due to the buoyancy of buoyant lever 304 said lever arrangement pivots around its pivot connection 354 and nose 356 of lever arm 306, which extends through slot 358 of the forked rod restraining means 310 presses against the inner wall 359 of channel 330 and blocks the downward path of depending arm 328 thereby effectively preventing the descent of the valve stem.

As will be realized because of the interaction between the nose 356 of lever arm 306 and the surface 359 against which it is pressed, the vector pressures are distributed between said static surface 359 and said lever arm 306 so that said lever arm is not and need now support the entire weight of the valve stem 322 even though the bottom face 360 of depending arm 328 is effectively sitting on said nose 356 of said lever arm.

In this manner nose 356 of said lever arm exerts a blocking maintaining force against integral arm 328 of valve stem 322 to overcome the effectively negative overall buoyancy of said water outlet valve while the cistern is emptying and in fact until after the completion of the flushing action.

When the water lever drops below the buoyant means 308, the pulling action of the water on said float at the end of the flushing action is strong enough to cause the disengagement of said nose 356 from said inner wall, whereupon said valve, by virtue of its own weight, will fall back into place with valve disc 318 sealing valve seat 320 of water outlet 214.

Preferably said bottom face 360 of depending arm 328 is slanted, as shown, so that as soon as the water level drops below the buoyant means 308 releasing the pressure between said nose 356 and said wall 359 said bottom 360 wedges its way therebetween to further push said nose away from said wall and thereby assure adequate clearance for the repositioning of face 344 of restraining means 310 in abutting restraining relationship with face 342 of lever arm 306 as restraining means 310 also returns to its first normal position by virtue of its own weight and/or by the action of lever 336 thereon.

It is to be noted with reference to FIGS. 5 and 7 that the design and spacing of the parts is preferably such that not only does depending arm 328 rest on the nose 356 of lever arm 306 but the web 362 of slot 358 of the forked rod restraining means 310 is also intended to be blocked by and rest on a top section 364 of said lever arm 306 after it has passed through the slot 358 after the initial displacement of said restraining means 310. In this manner, lever arm 306 also indirectly acts on the valve stem 322 to maintain it in its raised position since said arm supports forked rod 310, which in turn will hold up lever 336, which in turn holds up lever 334, which in turn holds up stem 322. This interaction is not shown with the proper interpositioning in FIG. 7, however, can, nevertheless, be understood with reference to the drawings.

As can be appreciated, two major advantages residing in the mechanism just disclosed are the fact that the buoyant means which is adapted to hold open the water valve is independently movable therefrom and due to the provided restraining means will not act upon the valve 302 to open the same or prevent its proper closure except when intentionally operated and actuated to effect the flushing action; and the fact that the close proximity of said buoyant means 308 to the bottom of the cistern assures that the valve remains completely open to allow an optimal outflow throughout the entire flushing action and until the completion thereof.

Figure 8:
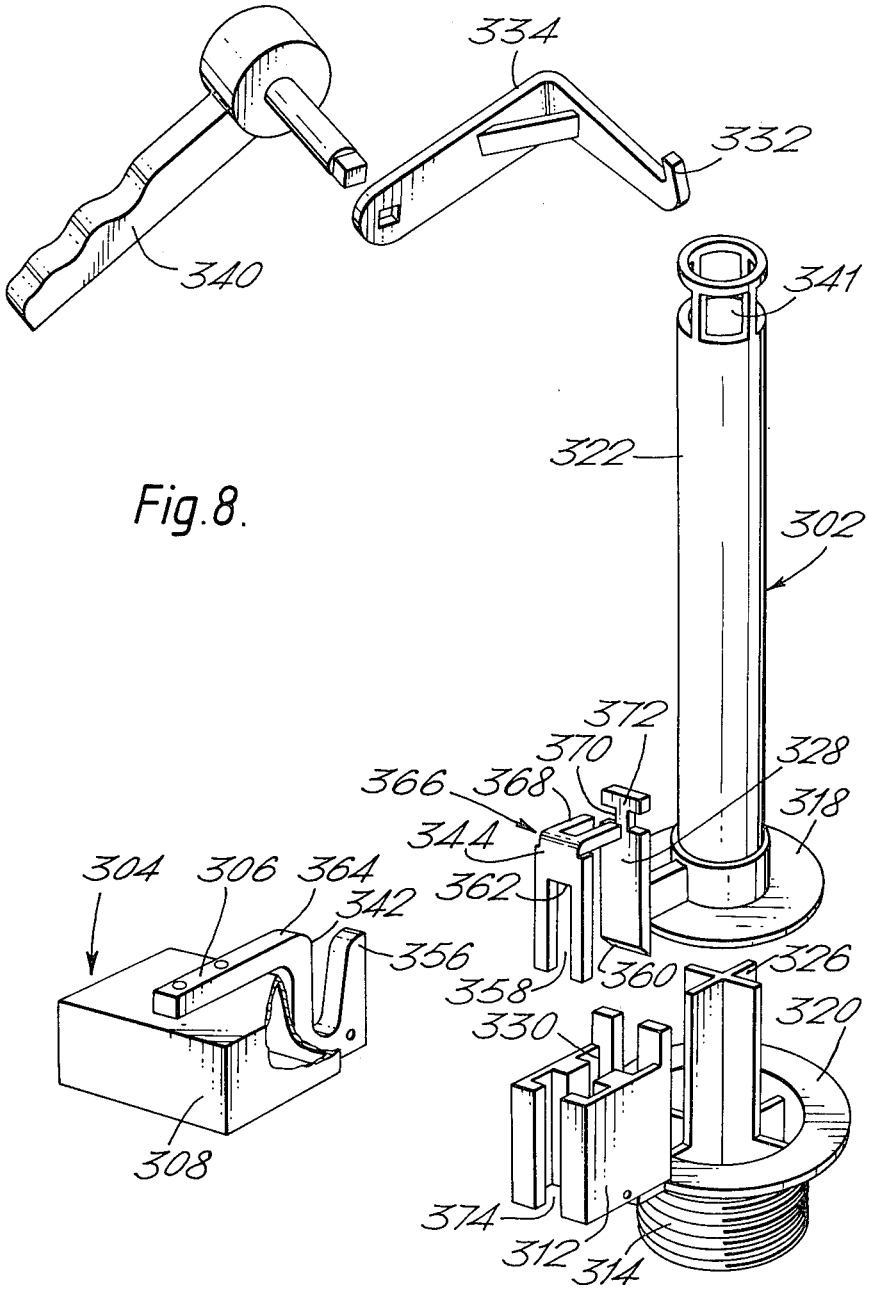
FIG. 8 is an exploded isometric view of a modification of the embodiments shown in FIGS. 5–7 adapted for single-flush operation only.

Referring now to FIG. 8, there is shown a modification of the embodiments shown in FIG. 5–7 adapted for single flush operation only, wherein restraining means 310 has been replaced by restraining means 366 of slightly different configuration the lower section of which corresponds to the lower section of restraining means 310 and which has been modified to include a projecting forked arm 368, the function of which is described hereinafter, instead of continuing upward and terminating in an eye 352.

Thus, in the embodiment shown, said restraining means 366 is provided with a forked arm 368 projecting towards said water outlet valve 302 which arm is adapted to engage the side slots 370 of the T shaped top 372 of the depending arm 328 and to be lifted by the projecting bottom surfaces of said slots upon the disengagement of said valve 302 from said water outlet, whereupon face 344 of said forked rod restraining means is lifted away from its abutting relationship with face 342 of lever arm 306 to allow said lever arm to effectively prevent the descent of the valve stem as previously described.

The operation of the flushing action of said single volume flush arrangement is in principal the same as that described with reference to FIG. 4 with the exception of the differences already described both above and with reference to FIG. 7 with bottom 360 of arm 328 being adapted to push nose 356 of arm 306 away as described to insure the repositioning of said restraining means in its first position upon the completion of the flushing action.

As will be noted with reference to the especially preferred embodiment of FIGS. 4–7, not only does the channeled guiding and mounting unit 312 serve to assure the easy mounting and guided vertical movement of the water outlet valve 302 by controlling the movement of arm 328 in channel 330 but also forked restraining rods 366 and, alternatively, 310, are also controlled and guided in their vertical path by guide channel 374 provided therein. Furthermore, since all of the interaction of parts and especially the maintaining force is created and exercised within the closed confines of said guiding and mounting unit the chances of malfunction are greatly reduced.

While particular embodiments of the invention have been described, it will be evident to those skilled in the art that the present invention may be embodied in other specific forms without departing from the essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A flush valve mechanism for controlling the flushing action of water through the water outlet of a flush cistern comprising a water outlet valve liftable off said water outlet to effect said flushing action and a buoyant, valve-engaging assembly adapted to move independently of said water outlet valve by virtue of its buoyancy, said water outlet valve having an effectively negative overall buoyancy when the cistern is at least partially full, and said assembly comprising a pivotably mounted buoyant lever having at least one arm with a buoyant means attached at one end thereof adjacent the bottom of said cistern and provided with means at its other end for selectively engaging said valve, said assembly further comprising restraining means being displaceable between a first position and a second position, said restraining means in said first position normally engaging and restraining said buoyant lever with said buoyant means in close proximity to said cistern bottom and said engaging means in disengaged relationship to said valve, said restraining means in said second position freeing said buoyant lever and allowing the same to engage and to exert a maintaining force on said water outlet valve at the completion of the lifting thereof to overcome its negative buoyancy and to hold it open until the completion of the flushing action.

2. A flush valve mechanism for the water outlet of a flush cistern as claimed in claim 1 wherein said water outlet valve is a lift valve.

3. A flush valve mechanism for the water outlet of a flush cistern as claimed in claim 1 wherein said water outlet valve comprises a tubular hollowed upwardly extending valve stem which constitutes the overflow pipe of the cistern.

4. A flush valve mechanism as claimed in claim 1 wherein said restraining means comprise a rod disposed in a channel for guided vertical displacement and having a face surface which in said first position abuts a surface of said buoyant lever and presents the movement thereof towards said valve.

5. A flush valve mechanism as claimed in claim 4 wherein said rod is provided with engagement means rendering the same liftable simultaneously with said water outlet valve whereby upon the lifting of said water outlet valve and said restraining means said buoyant lever is freed to engage and exert a maintaining force on said lifted water outlet valve.

6. A flush valve mechanism according to claim 4 wherein said water outlet valve comprises a depending vertical arm attached to an upwardly extending valve stem and said mechanism further comprises a channeled integral guide and mounting unit, said unit having a first channel to receive and guide said valve stem arm and a second channel to receive and guide said restraining rod, the arrangement being such that upon the lifting of said water outlet valve and said restraining means said buoyant lever is freed and the engaging means thereof passes under a bottom surface of said depending arm to press against an inner wall of said first channel and to engage and block the downward path of said depending valve stem arm thereby effectively exerting said maintaining force on said water outlet valve.

7. A flush valve mechanism as claimed in claim 4 which said rod has a forked bottom section the web of which fork acts as said abutment face of said restraining means and wherein said engaging means of said buoyant lever extends between the legs of said forked rod upon displacement thereof to engage said water outlet valve.

8. A flush valve mechanism according to claim 4 wherein said mechanism further comprises a valve seat having a water outlet, a water outlet valve liftable off said water outlet seat, said water outlet valve comprises a depending arm attached to an upwardly extending valve stem and said mechanism further comprises a channeled integral guide and mounting unit, said unit having a channel to receive and guide said restraining rod, the arrangement being such that upon the lifting of said water outlet valve and said restraining means said buoyant lever is freed and the engaging means thereof passes under a bottom surface of said depending arm to press against a portion of said valve seat and to engage and block the downward path of said depending valve stem arm thereby effectively exerting said maintaining force on said water outlet valve.

9. A flush valve mechanism for the water outlet of a flush cistern as claimed in claim 1 wherein said buoyant lever is adapted upon displacement of said restraining means to exert a frictional maintaining pressure against a section of the water outlet valve to overcome the effectively negative overall buoyancy of said water outlet valve after the lifting thereof and while the cistern is emptying, until the completion of the flushing action.

10. A selective volume flush valve mechanism according to claim 1 adapted to selectively allow both partial and complete flushes comprising a water outlet valve having an effectively positive overall buoyancy when the water in the cistern is at a predetermined full level and an effectively negative overall buoyancy when the water in the cistern is emptied to a second lower partially full level and further comprising dual actuating means for said flush valve mechanism, the first of said means comprising a mechanism for effecting the disengagement of said valve from said water outlet and the second of said actuating means comprising a mechanism for effecting the disengagement of said valve from said water outlet and for displacing said restraining means from its first position to said second position to enable said buoyant lever to exert a maintaining force on said disengaged water valve to overcome its negative buoyancy and to hold it open while the cistern is emptying and until the completion of a complete flushing action.

11. A single volume flush valve mechanism according to claim 1 comprising means for displacing said restraining means from its first position to said second position upon the disengagement of said valve from said water outlet, to enable said buoyant lever to engage said disengaged water outlet valve and to exert a maintaining force thereon to overcome its negative buoyancy while the cistern is emptying, until the completion of the flushing action.

12. A single volume flush valve mechanism according to claim 11 wherein said restraining means is provided with an arm projecting towards said water outlet valve adapted to be engaged by a first projection provided on said water outlet valve and lifted thereby upon the disengagement of said valve from said water outlet, and wherein said valve is further provided with a second projection adapted to press against said arm to insure the repositioning of said restraining means in its first position upon the completion of the flushing action and the disengagement of the buoyant lever from said water outlet valve.

* * * * *